US006105792A

United States Patent [19]

Chang

[11] Patent Number: 6,105,792

[45] Date of Patent: Aug. 22, 2000

[54] GOLF BAG CLUB RACK HAVING A NOTCH AND CLAMP ARRANGEMENT FOR HOLDING GOLF CLUBS THEREIN

[75] Inventor: Chen-Te Chang, Taichung Hsien, Taiwan

[73] Assignee: Minghung Plastic Industry Co., Ltd., Taiwan

[21] Appl. No.: 09/247,923

[22] Filed: Feb. 11, 1999

[51] Int. Cl.[7] ..... A63B 55/00

[52] U.S. Cl. ..... 211/70.2; 206/315.3; 206/315.6

[58] Field of Search ..... 211/70.2; 206/315.6, 206/315.2, 315.3

[56] References Cited

U.S. PATENT DOCUMENTS

| | | | |
|---|---|---|---|
| 3,503,518 | 3/1970 | Black | 211/70.2 |
| 4,055,207 | 10/1977 | Goodwin | 206/315.6 |
| 4,753,446 | 6/1988 | Mills | 280/47.18 |
| 4,960,212 | 10/1990 | Wu | 211/70.2 |
| 5,228,566 | 7/1993 | Shenoha | 206/315.6 |
| 5,383,555 | 1/1995 | Weinmeier | 206/315.6 |
| 5,620,091 | 4/1997 | Larson | 206/315.6 |
| 5,779,043 | 7/1998 | Hsu et al. | 211/70.2 X |
| 5,803,252 | 9/1998 | Huo-Chuan | 211/70.2 X |
| 5,884,780 | 3/1999 | Cho | 211/70.2 |
| 5,954,199 | 9/1999 | Stratton | 206/315.6 |
| 5,964,346 | 10/1999 | O'Connor | 211/70.2 X |

*Primary Examiner*—Daniel P. Stodola
*Assistant Examiner*—Gregory T. Strimbu
*Attorney, Agent, or Firm*—Bacon & Thomas PLLC

[57] ABSTRACT

A golf club rack for securing individual golf clubs in a golf bag comprising a rack portion and a mounting unit which adjustably secures the rack portion to the golf bag. The rack portion includes three club holding sections. Each of the club holding sections can have a different height with respect to one another. Each of the club holding sections has a plurality of insertion slots for receiving the golf clubs. Each of the insertion slots has a notch including a spring strip attached to a lateral side thereof and a clamp positioned opposite the notch. Each notch receives a head of a golf club with the spring strip holding the head of the golf club in the notch and the clamp clampingly receives the neck of the shaft of the golf club to secure the golf club with respect to the rack portion. The mounting unit has coupling members that are mountable on partition boards and the top cuff of the golf bag. The mounting unit is height adjustable with respect to the golf bag while the rack portion is height adjustable with respect to the mounting unit.

8 Claims, 16 Drawing Sheets

GOLF BAG CLUB RACK HAVING A NOTCH AND CLAMP ARRANGEMENT FOR HOLDING GOLF CLUBS THEREIN

BACKGROUND OF THE INVENTION

1. Field of the Invention

The present invention relates to golf bags, and more specifically to a club rack for holding individual golf clubs in a golf bag in good order.

2. Description of the Related Art

A regular golf bag, as shown in FIG. 1, has a sloping top mouth, and intersected partition boards in the sloping top mouth. The intersected partition boards separate the holding space of the golf bag into several storage chambers for holding golf clubs. Because one storage chamber is provided for holding a number of golf clubs, storage golf clubs cannot be kept in good order. The user may have to spend a lot of time in finding a particular golf club from the golf bag. In order to eliminate this problem, various club racks have been developed. FIGS. 2 and 3 show a prior art club rack for this purpose. This club rack comprises an elongated, sloping rack body having pairs of curved clamping strips at the top, a fixed mounting device integral with one end of the rack body, and a movable mounting device horizontally and slidably coupled to one end of the rack body remote from the fixed mounting device. The movable mounting device is adjusted to change the pitch between the fixed mounting device and the movable mounting device subject to the diameter of the top cuff of the golf bag. The fixed mounting device and the movable mounting device are respectively fastened to the top cuff of the golf bag. When in use, golf clubs are inserted into the golf bag, permitting the heads of stored golf clubs to be respectively secured to each pair of curved clamping strips. Because the heads of stored golf clubs are secured to the curved clamping strips but not hung on the top cuff of the golf bag, it is not convenient to pick up stored golf clubs from the golf bag. Because stored golf clubs are arranged in two rows at two opposite sides of the rack body, the shafts of the golf clubs may interfere with one another. When placing the golf bag cover over the golf bag, the golf bag cover may be damaged by the protruded part of the mounting devices. Furthermore, when the golf bag is turned upside-down, stored golf clubs will be forced by gravity to disengage from the curved clamping strips and fall out of the golf bag. FIG. 4 shows another golf club rack according to the prior art. This golf club rack is comprised of a cylindrical rack body having a stepped top side wall, and a plurality of rigid bushings respectively mounted in respective vertical through holes at the rack body. This golf club rack is not without flaws. When loading or unloading a golf club, it must be moved in and out of the rigid bushing vertically, and the peripheral edge of the shaft of the golf club tends to be damaged by the top edge of the rigid bushing during loading or unloading. Another drawback of this golf club rack is that stored golf clubs will be forced to rotate or vibrate in the rigid bushings when the golf bag is moved by the user or transported in a car, and the heads of storage golf clubs will hit against another. When storage golf clubs are vibrated, the shafts of the stored golf clubs will be forced to entangle one another, and the user shall have to spend excess time in taking the stored golf clubs out of the golf bag. Furthermore, when the golf bag falls to the ground or is turned upside-down, stored golf clubs will fall out of the rigid bushings.

SUMMARY OF THE INVENTION

It is one object of the present invention to provide a golf club rack for a golf bag, which holds golf clubs in respective insertion slots individually, and secures the golf clubs firmly in the respective insertion slots. It is another object of the present invention to provide a golf club rack for a golf bag, which can be conveniently adjusted to fit the size of the golf bag used and the size of the golf clubs stored in it. To achieve these and other objects of the present invention, there is provided a club rack for a golf bag which is comprised of a rack, and a mounting unit fastened to the top cuff of a golf bag to hold the rack for holding golf clubs in respective insertion slots in the rack individually, the rack being a three-step shell divided into three club holding sections, each club holding section having a plurality of insertion slots for receiving golf clubs individually, a notch in each insertion slot for the resting of the head of the corresponding golf club, and clamp device for securing the neck of the head of the corresponding golf club in position, the mounting unit having coupling members mounted on intersected partition boards and the top cuff of the golf bag for connection to respective coupling members at the bottom side of the rack, enabling the rack to be adjusted to the desired elevation.

DETAILED DESCRIPTION OF THE PREFERRED EMBODIMENT

Referring to FIGS. from 5 through 8, a club rack for a golf bag in accordance with the present invention is generally comprised of a rack 1, and a mounting unit 51, 55, 56.

Figure 1:
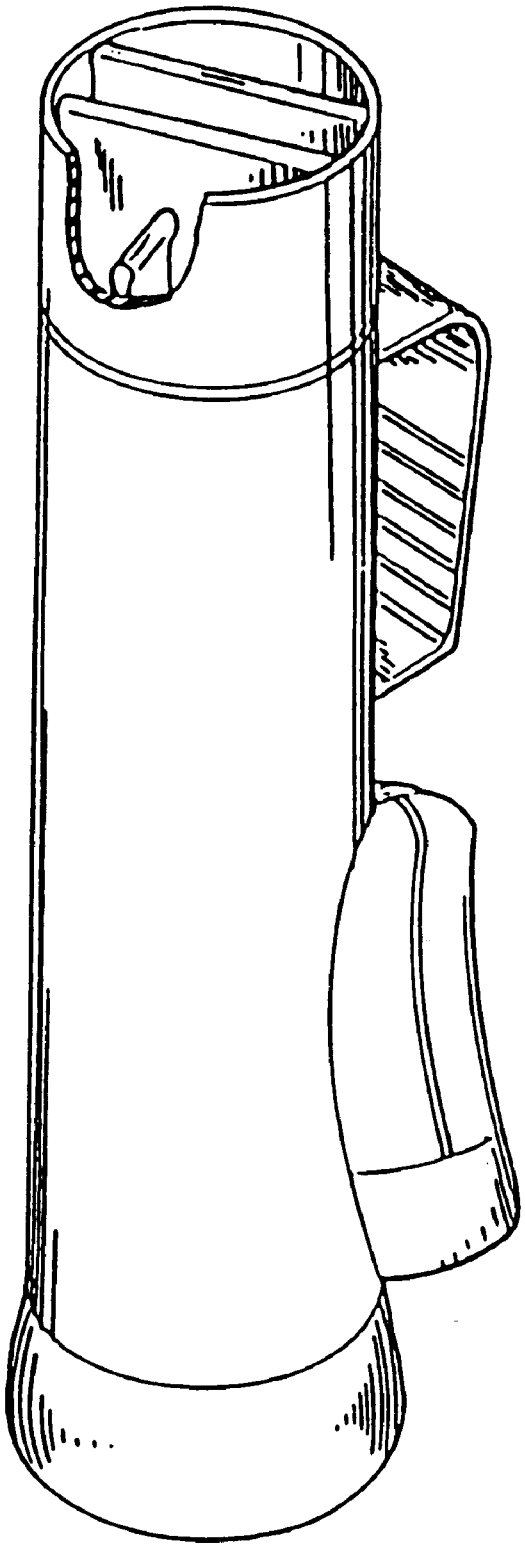
Fig·1 PRIOR ART
FIG. 1 is a perspective view of a regular golf bag according to the prior art.
Figure 2:
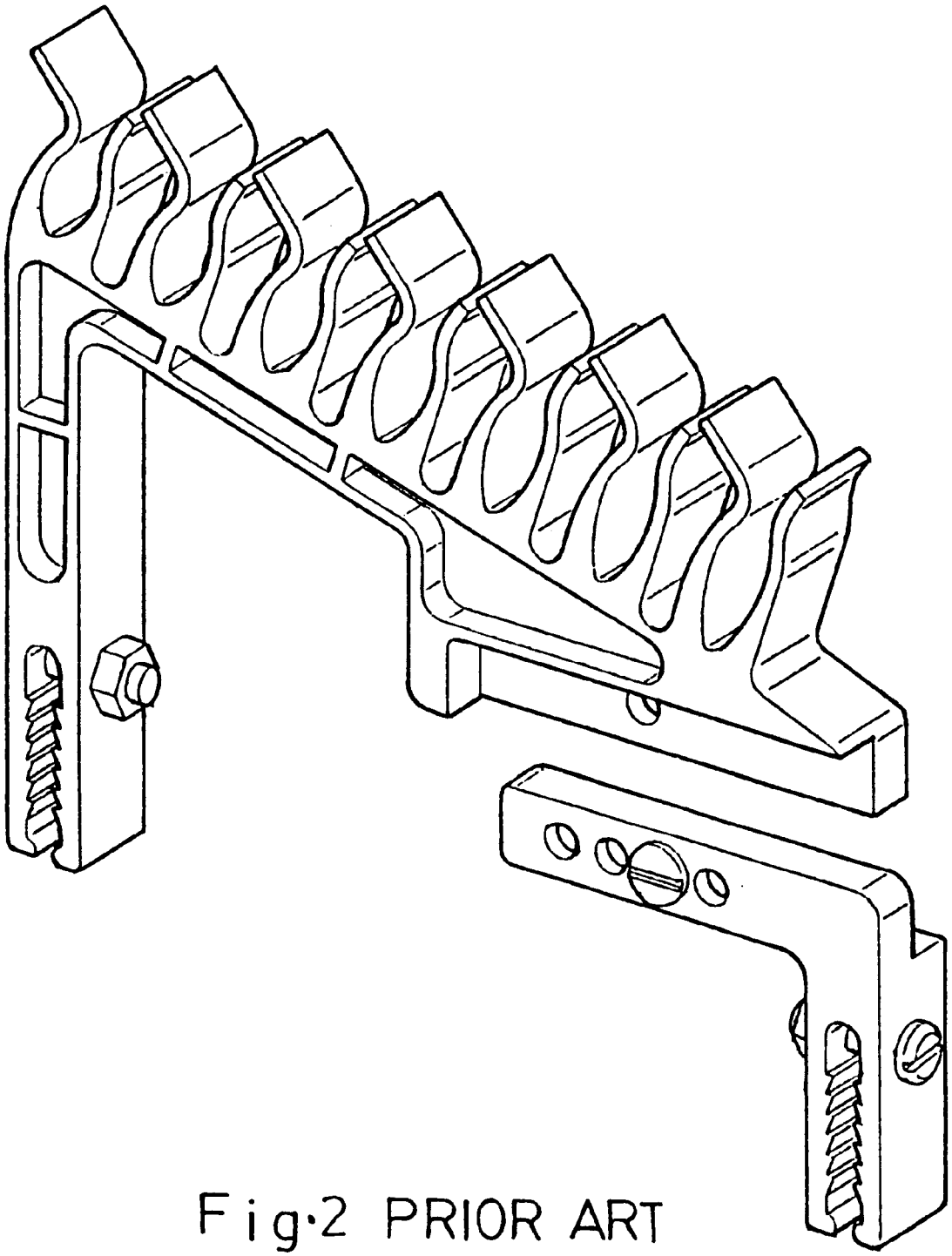
Fig·2 PRIOR ART
FIG. 2 is an exploded view of a club rack for a golf bag according to the prior art.
Figure 3:
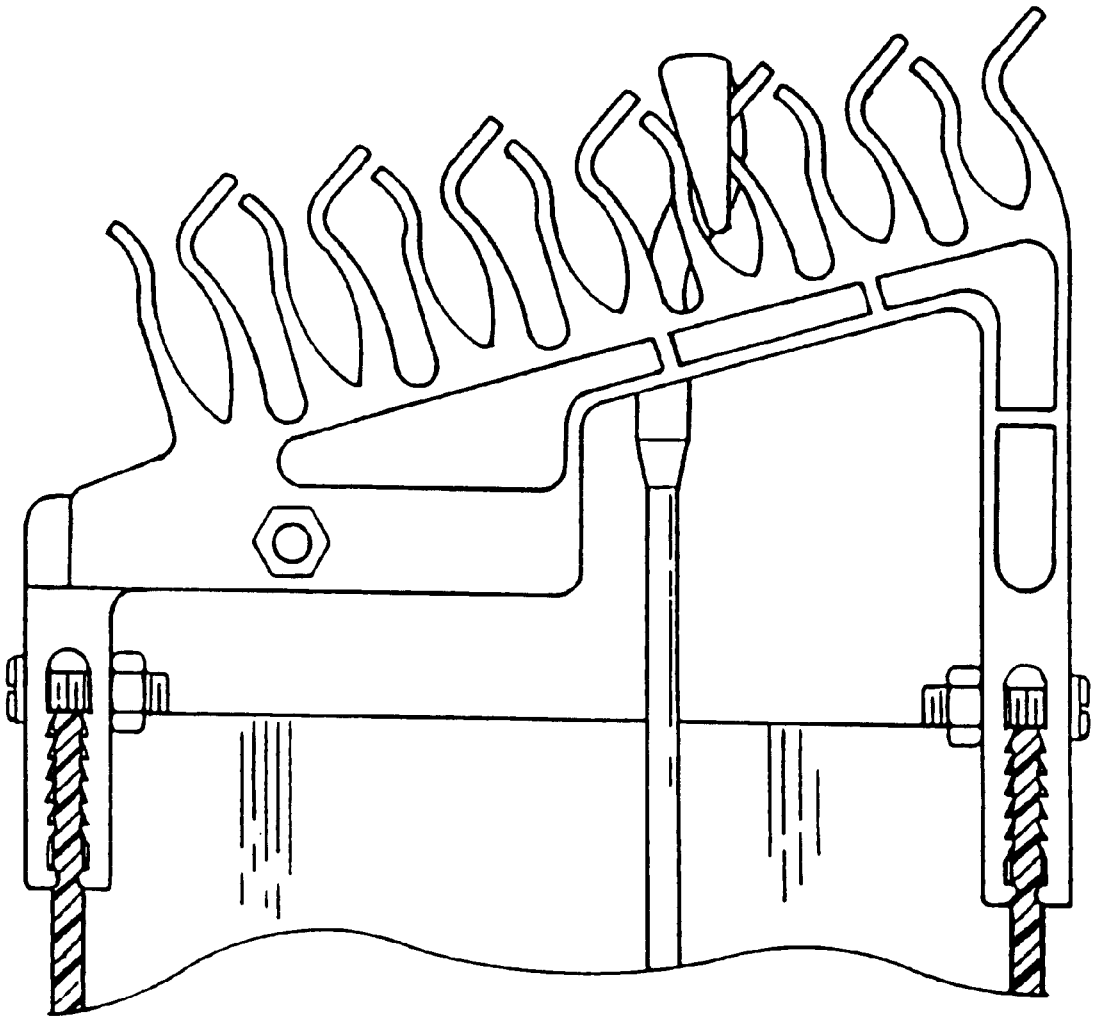
Fig·3 PRIOR ART
FIG. 3 is a sectional view of the club rack of FIG. 2 installed in a golf bag according to the prior art.
Figure 4:
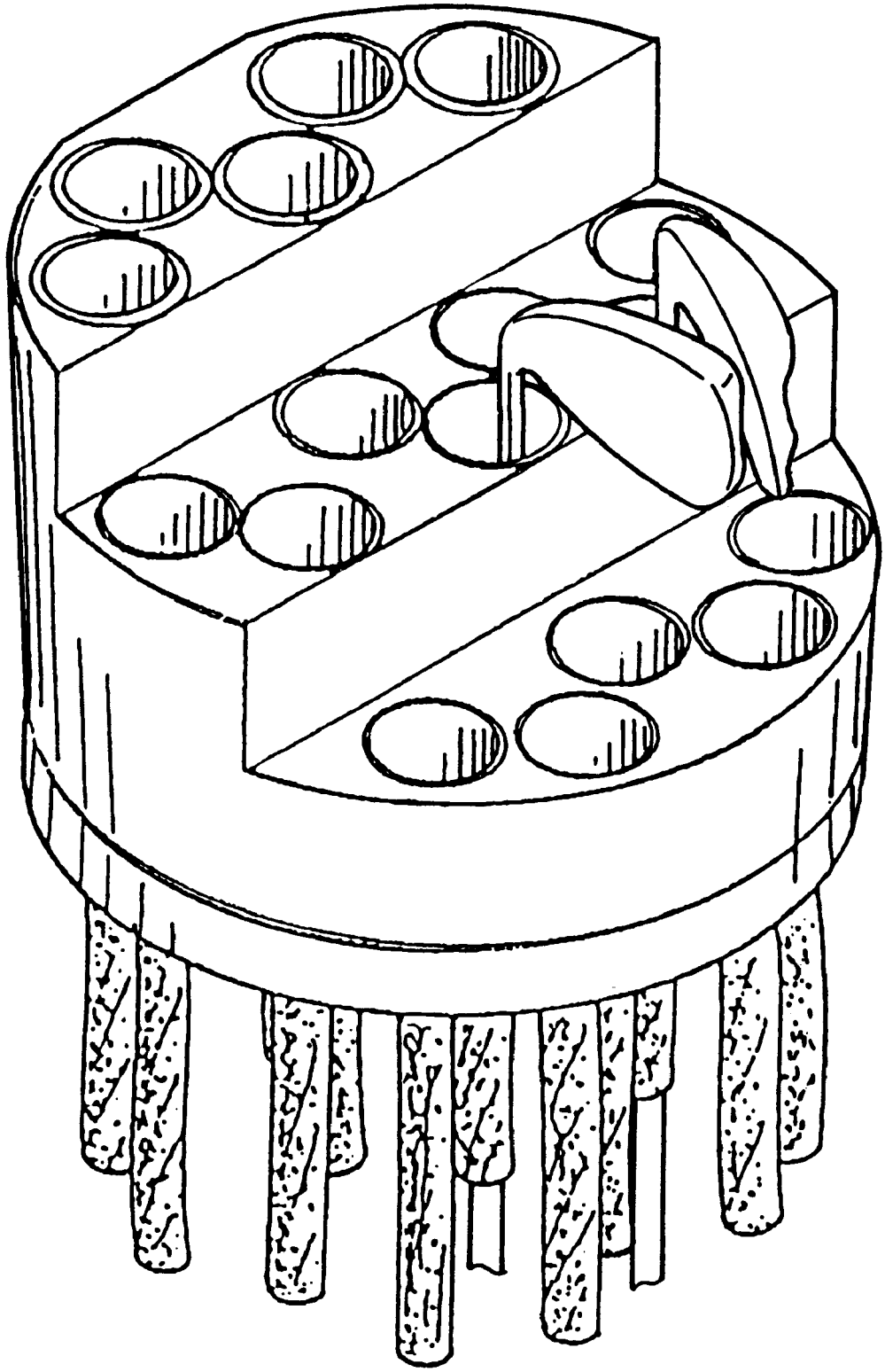
Fig·4 PRIOR ART
FIG. 4 is a perspective view of another structure of club rack for a golf bag according to the prior art.
Figure 5:
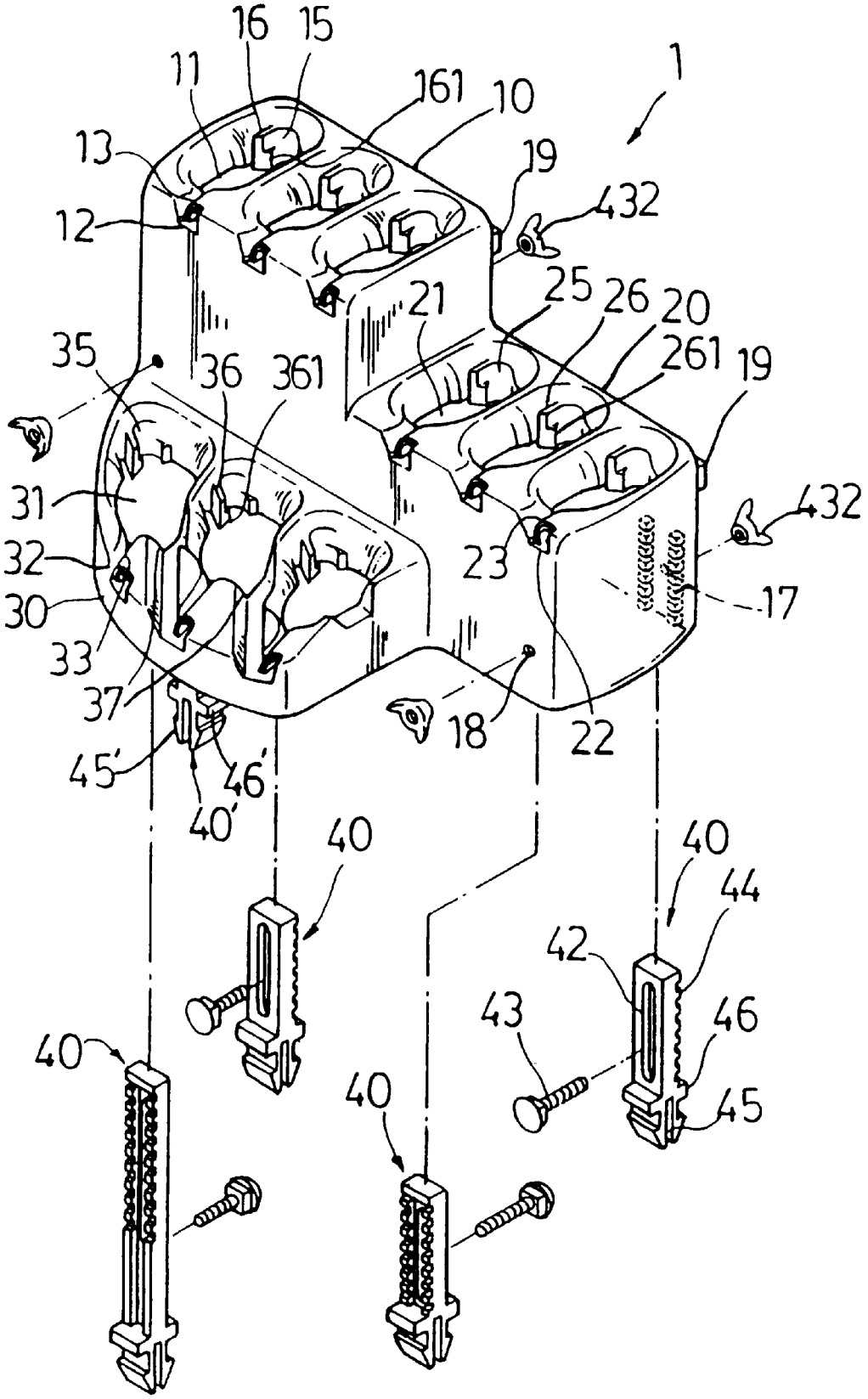
FIG. 5 is an exploded view of a golf club rack according to the present invention.
Figure 6:
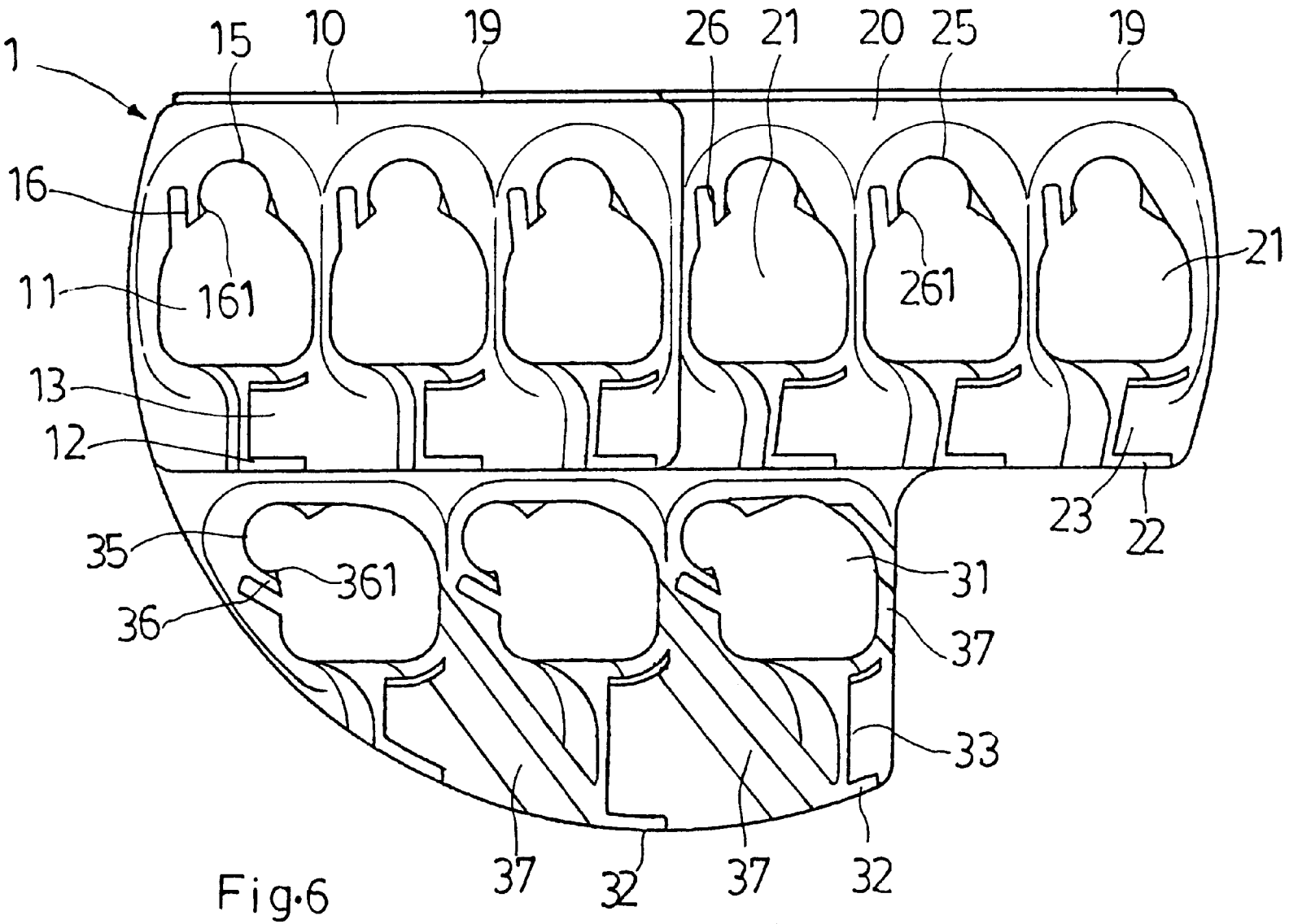
FIG. 6 is a top plan view in an enlarged scale of the rack shown in FIG. 5.
Figure 7:
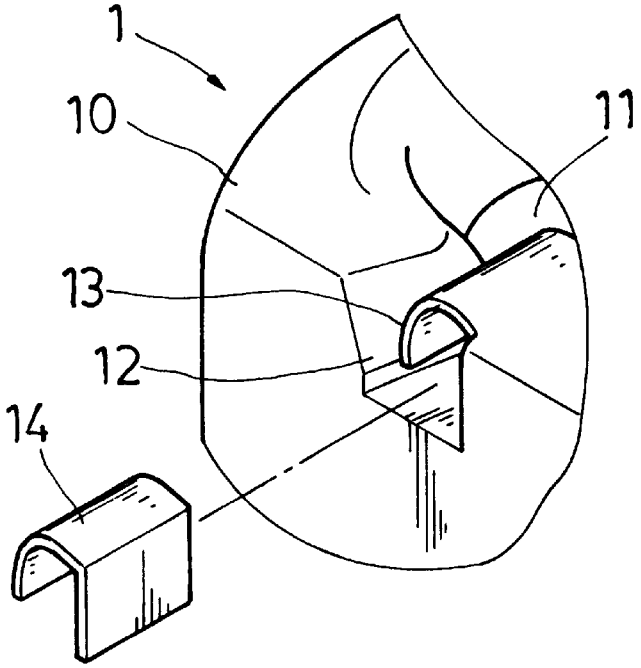
FIG. 7 is an enlarged view of a part of the rack according to the present invention, showing the stretcher removed from the corresponding notch.
Figure 8:
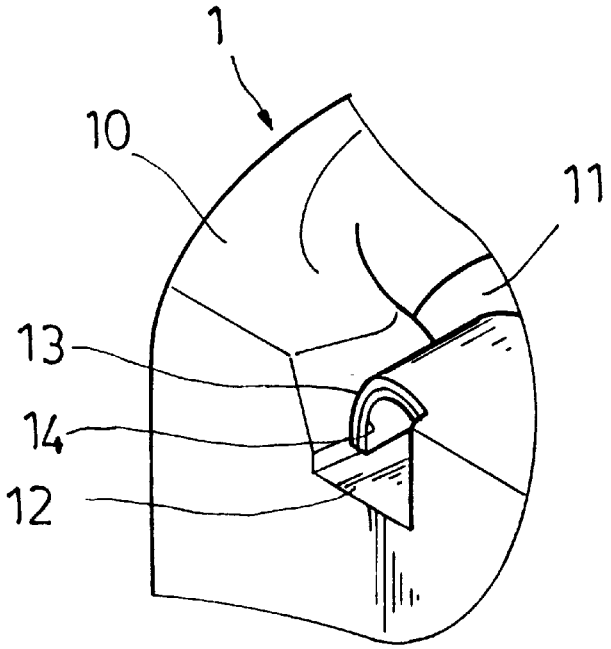
FIG. 8 is an assembled view of FIG. 7 with the stretcher inside the notch.
Figure 9:
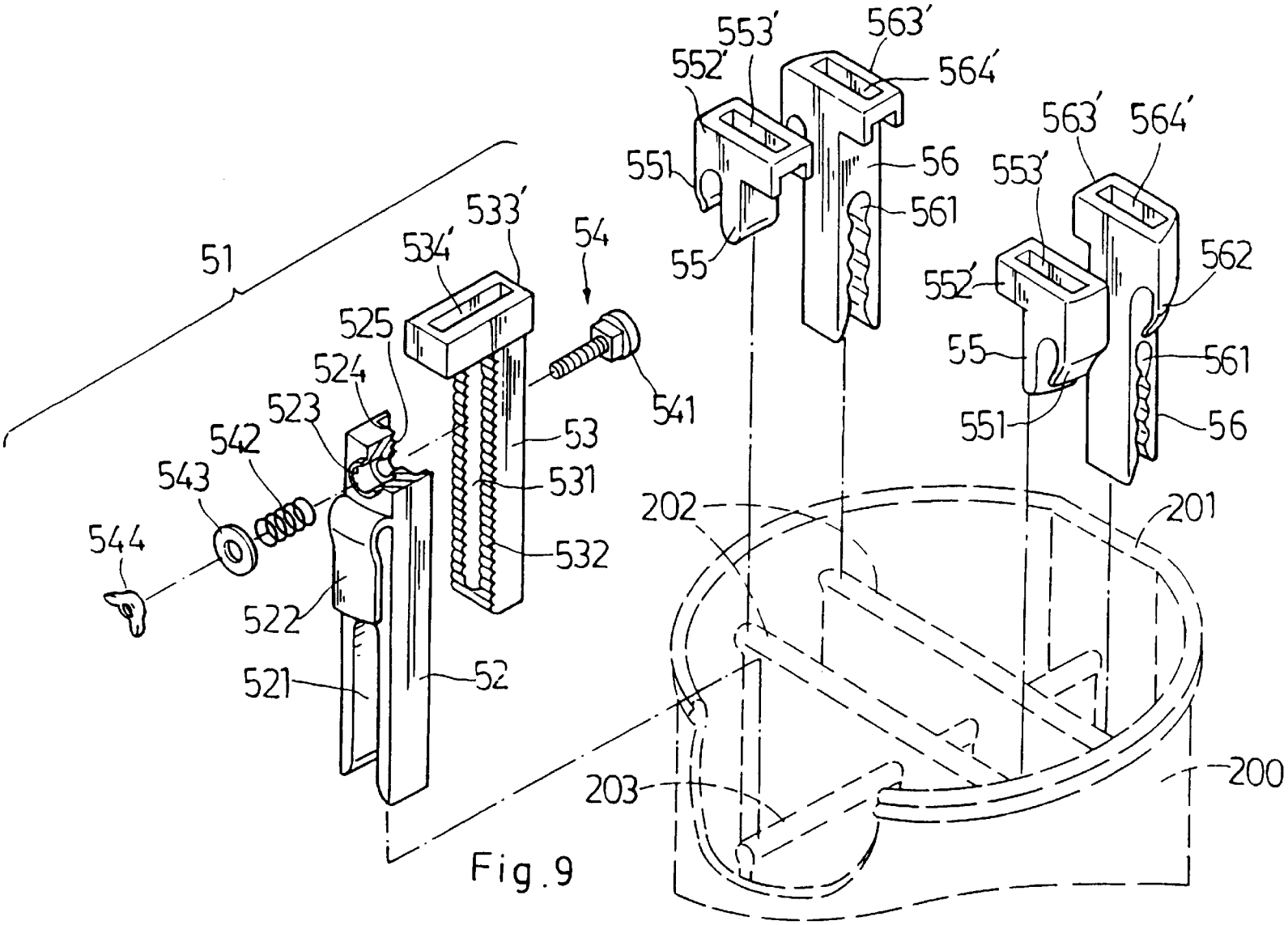
FIG. 9 is an exploded view of a mounting unit for a club rack according to the present invention.

Referring to FIG. 5, the rack 1 comprises a first club holding section 10, a second club holding section 20, and a third club holding section 30. The club holding sections 10, 20, and 30 are disposed at different elevations. The top side of the first club holding section 10 is higher than the top side of the second club holding section 20. The third club holding section 30 is integral with one common front side wall of the first and second club holding sections 10 and 20, and its top side is lower than the top side of the second club holding section 20. The first and second club holding sections 10 and 20 each have a smoothly curved outer side wall. The top side wall of the third club holding section 30 slopes downwardly forwards from the common front side wall of the first and second club holding sections 20 and 30. The top side wall of the first and second club holding sections 10 and 20 slope downwardly forwards in the same direction.

The club holding sections 10, 20, and 30 each define a plurality of insertion slots 11, 21, or 31 of oval shape for the insertion of golf clubs individually. A notch 12, 22, or 32 is provided at one end of each insertion slot 11, 21, or 31. The notches 12, 22, and 32 each have a smoothly curved peripheral wall fitting the curvature of the head of a golf club. A smoothly curved spring strip 13, 23 or 33 is respectively suspended from one lateral side of each notch 12, 22 or 32. Clamps 15 and 25 are respectively provided in the insertion slots 11 and 21 of the first and second club holding sections 10 and 20 at one side opposite to the respective notches 12 and 22. Clamps 35 are respectively provided in the insertion slots 31 of the third club holding section 30 at a location diagonal to the respective notches 32. A stretcher 14 is respectively provided in each notch 12, 22, or 32 to support and stretch open the respective spring strip 13, 23 or 33. The clamps 15, 25 and 35 each have a resilient wing 16, 26 or 36 extending in direction toward the center of the respective insertion slot 11, 21 or 31 and terminating in a tip 161, 261 or 361. Locating grooves 37 are provided at the top side wall of the third club holding section 30 corresponding to the respective insertion slots 31 opposite to the respective clamps 35.

Elongated coupling members 40 and 40' are respectively provided at the bottom side walls of the club holding sections 10, 20, and 30. The coupling members 40 and 40' each have a bottom end terminating in a shoulder 46 or 46' and then a split hook 45 or 45'. The coupling members 40' are fixedly connected to the bottom side wall of the third club holding section 30. The other coupling members 40 each comprise a longitudinal slot 42. The coupling members 40 are respectively and vertically adjustably mounted in the first and second club holding sections 10 and 20 at the bottom side, and fixedly secured in place at the desired elevation by a respective screw 43 and a respective wing nut 432. The screw 43 is inserted through a respective through hole 18 in the rack 1 and the longitudinal slot 42 at the corresponding coupling member 40, and then screwed up with the respective wing nut 432 to fix the respective coupling member 40 in place. The coupling members 40 each further comprise two serrated portions 44 longitudinally disposed in parallel at one side for engagement with a respective pair of serrated portions 17 inside the rack 1.

Referring to Figures from 9 through 12, the mounting unit 51, 55, 56 is mounted in the golf bag 200 near the top to stretch open the top cuff 201 of the golf bag 200. The golf bag 200 comprises two first partition boards 202 arranged in parallel, and a second partition board 203 intersected with the first partition boards 202. The mounting unit 51, 55, 56 comprises a first coupling member 51, two second coupling members 55, and two third coupling members 56. The first coupling member 51 is fastened to the second partition board 203. The second coupling members 55 are respectively fastened to the top cuff 201 of the golf bag 200. The third coupling members 56 are respectively fastened to the first partition boards 202. The first coupling member 51 is comprised of a fixed bar 52 and a movable bar 53. The fixed bar 52 comprises a downwardly longitudinally extended clamping mouth 521, which is clamped on the second partition board 203, a clip 522 raised from one side thereof, which is fastened to the top cuff 201 of the golf bag 200, a transverse through hole 523 is disposed at the top of the fixed bar, a longitudinal track 524 formed at one side wall thereof opposite to the clip 522, and longitudinally extended serrated portions 525 formed at the track 524. The movable bar 53 comprises a longitudinal sliding slot 531 fastened to the through hole 523 at the fixed bar 52 by a fastening device 54, longitudinally extended serrated portions 532 meshed with the serrated portions 525 on the fixed bar 52, a top coupling head 533, and a T-groove 534 at the top coupling head 533, which receives the split hook 45' of the coupling member 40' of the rack 1, permitting the shoulder 46' of the coupling member 40' to be stopped at the top side wall of the top coupling head 533. The fastening device 54 comprises a screw bolt 541 inserted through the longitudinal sliding slot 531 on the movable bar 53 and the transverse through hole 523, a wing nut 544 threaded onto the screw bolt 541 to fix the movable bar 53 and the fixed bar 52 together, a spring 542 mounted on the screw bolt 541 within the transverse through hole 523 and stopped between the head of the screw bolt 541 and the wing nut 544, and a washer 543 mounted on the screw bolt 541 and retained between the spring 542 and the wing nut 544. The second coupling member 55 comprises a downwardly longitudinally extended clamping mouth 551, which is clamped on the top cuff 201 of the golf bag 200, a top coupling head 552, and a T-groove 553 at the top coupling head 552 which receives the split hook 45 of one coupling member 40, permitting the shoulder 46 of the respective coupling member 40 to be stopped at the top side wall of the top coupling head 553. The third coupling member 56 comprises a downwardly longitudinally extended and serrated clamping mouth 561, which is clamped on one first partition board 202 of the golf bag 200, a clip 562 at one side, which is fastened to the top cuff 201 of the golf bag 200, a top coupling head 563, and a T-groove 564 at the top coupling head 563 which receives the split hook 45 of one coupling member 40, permitting the shoulder 46 of the respective coupling member 40 to be stopped at the top side wall of the top coupling head 564.

Figure 10:
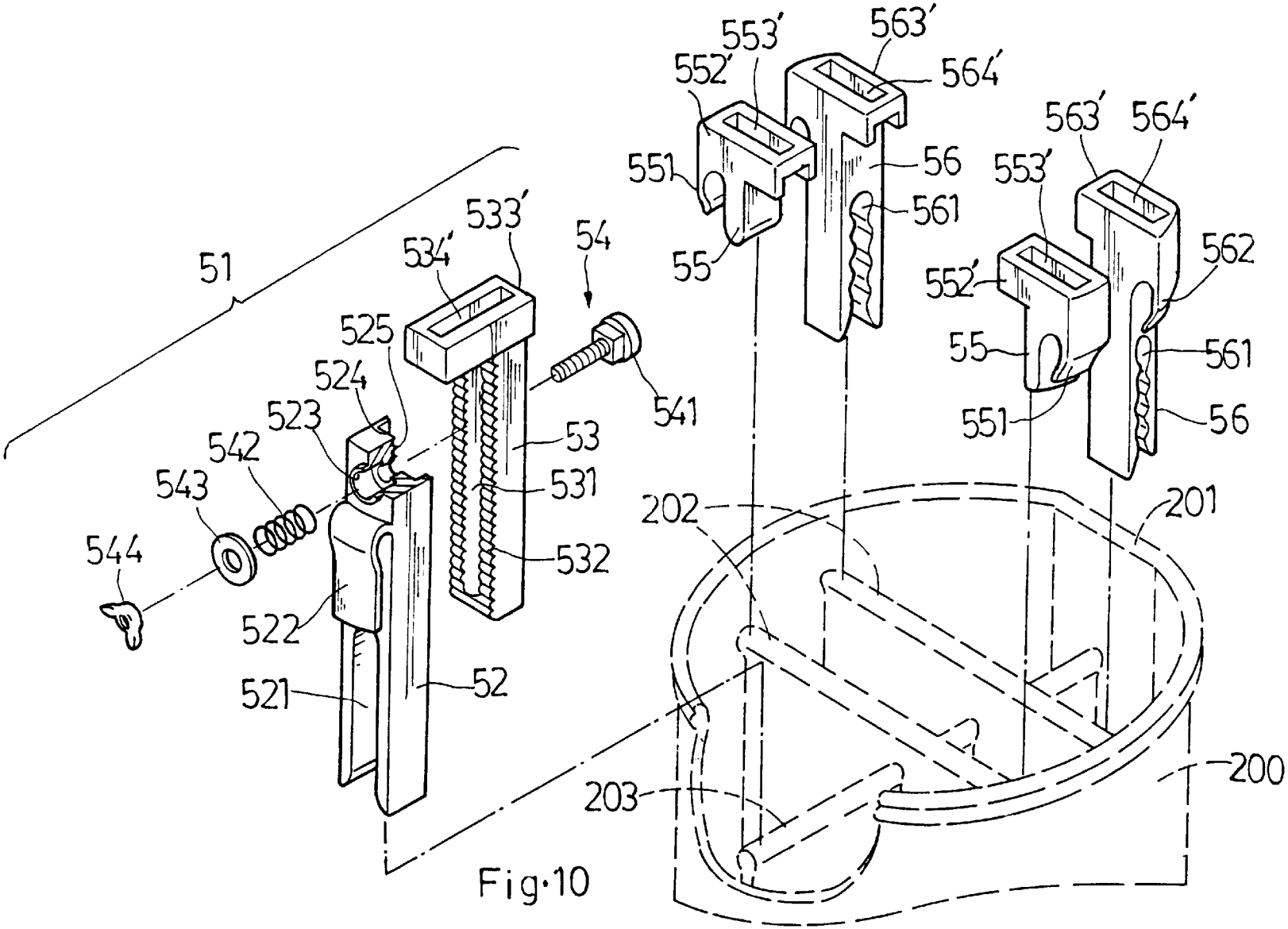
FIG. 10 is an exploded view of an alternate embodiment of the mounting unit according to the present invention.

Referring to FIG. 10, the top coupling head 533', 552' and 563' can be made having an invertedly disposed T-shaped coupling hole 534', 553' or 564' for engagement with the split hook 45 or 45' of the corresponding coupling member 40 or 40'.

Figure 11:
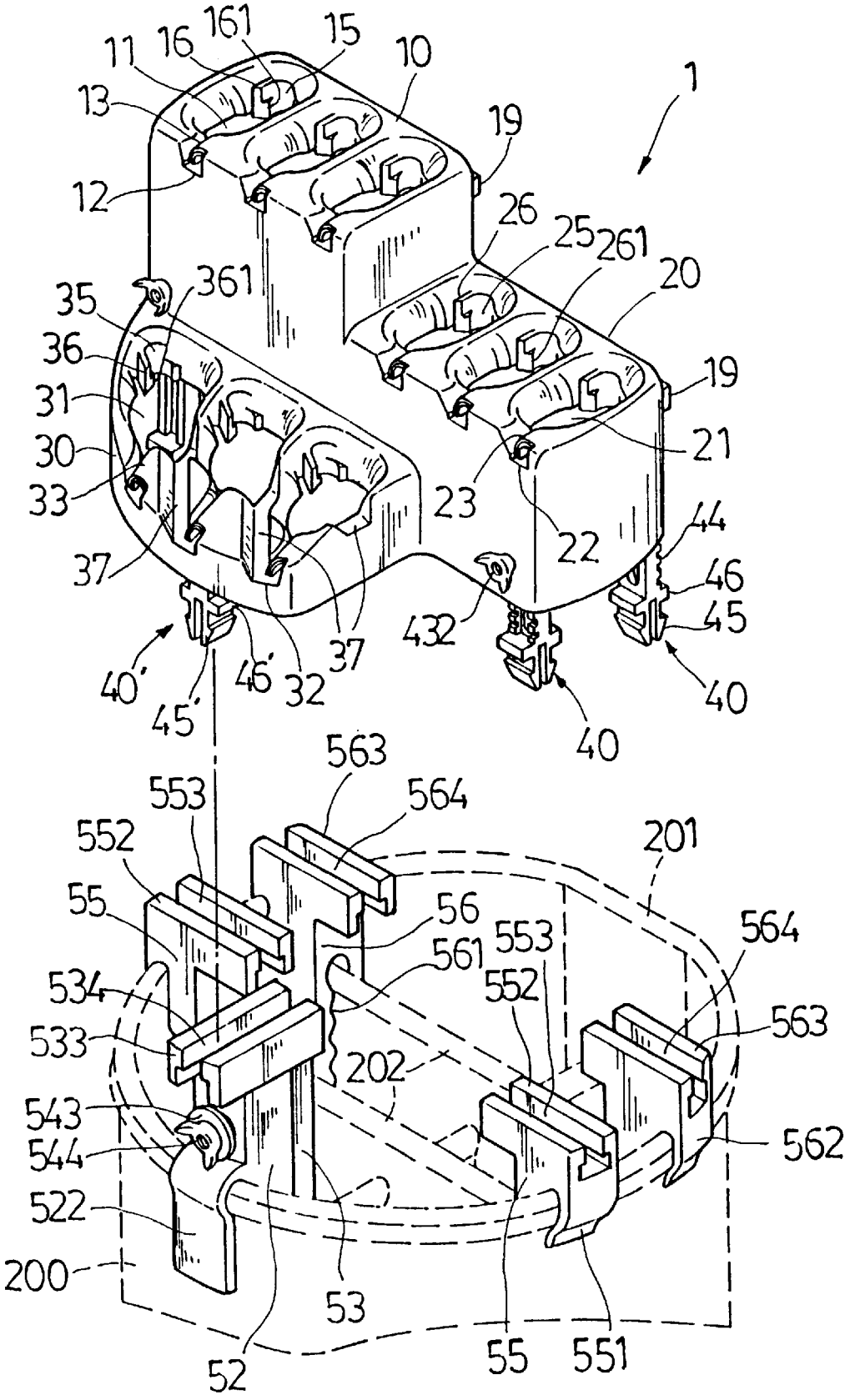
FIG. 11 is an exploded view of the present invention, showing the mounting unit installed in the golf bag according to the present invention.
Figure 12:
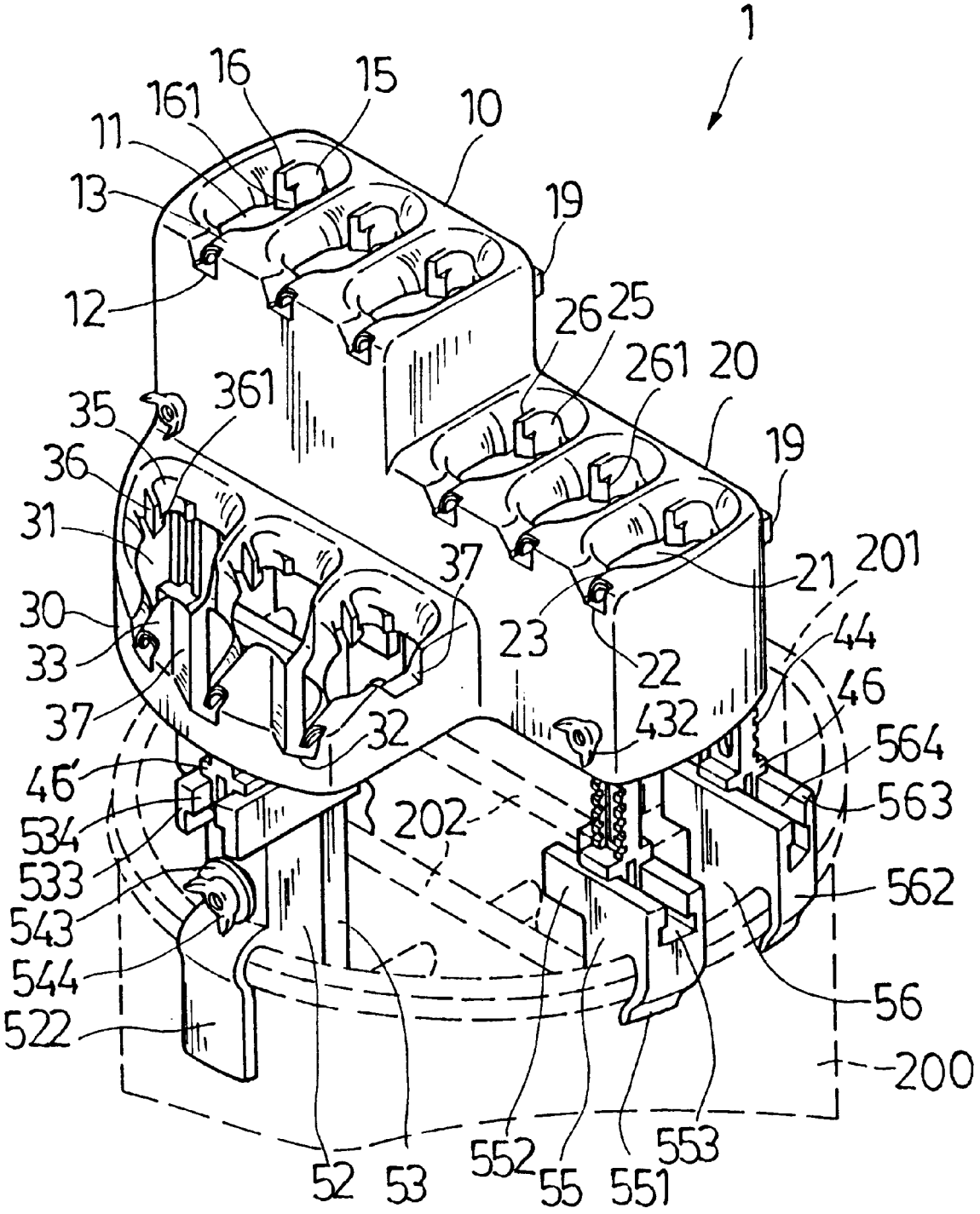
FIG. 12 is an assembled view of FIG. 11.

Referring to FIGS. 11 and 12 again, after installation of the mounting unit 51, 55, 56 in the golf bag 200, the coupling members 40 and 40' of the rack 1 are respectively fastened to the first coupling members 51, second coupling members 55 and third coupling members 56 of the mounting unit 51, 55, 56. The elevation of the rack 1 can be adjusted relative to the mounting unit 50. When the wing nut 544 is loosened from the screw bolt 541, the movable bar 53 is allowed to be moved vertically relative to the fixed bar 52. When the wing nuts 432 are respectively loosened from the respective screws 43, the rack 1 can be adjusted vertically relative to the coupling members 40. After adjustment, the nuts 432 and 544 and the respective screws 43 and 541 are respectively fastened up again to fix the rack 1 at the adjusted elevation.

Figure 13:
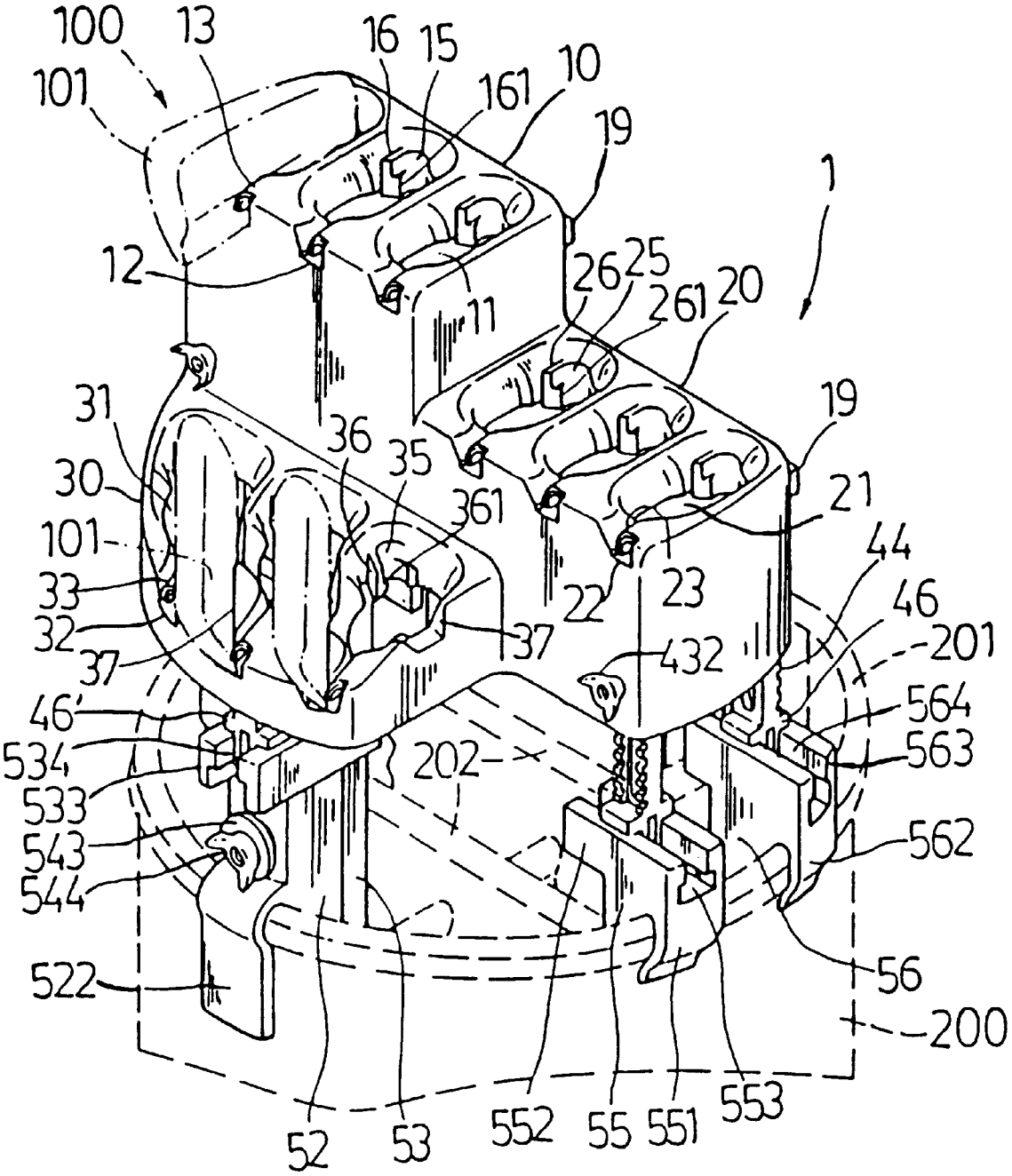
FIG. 13 shows the placement of clubs in the device of FIG. 12.
Figure 14:
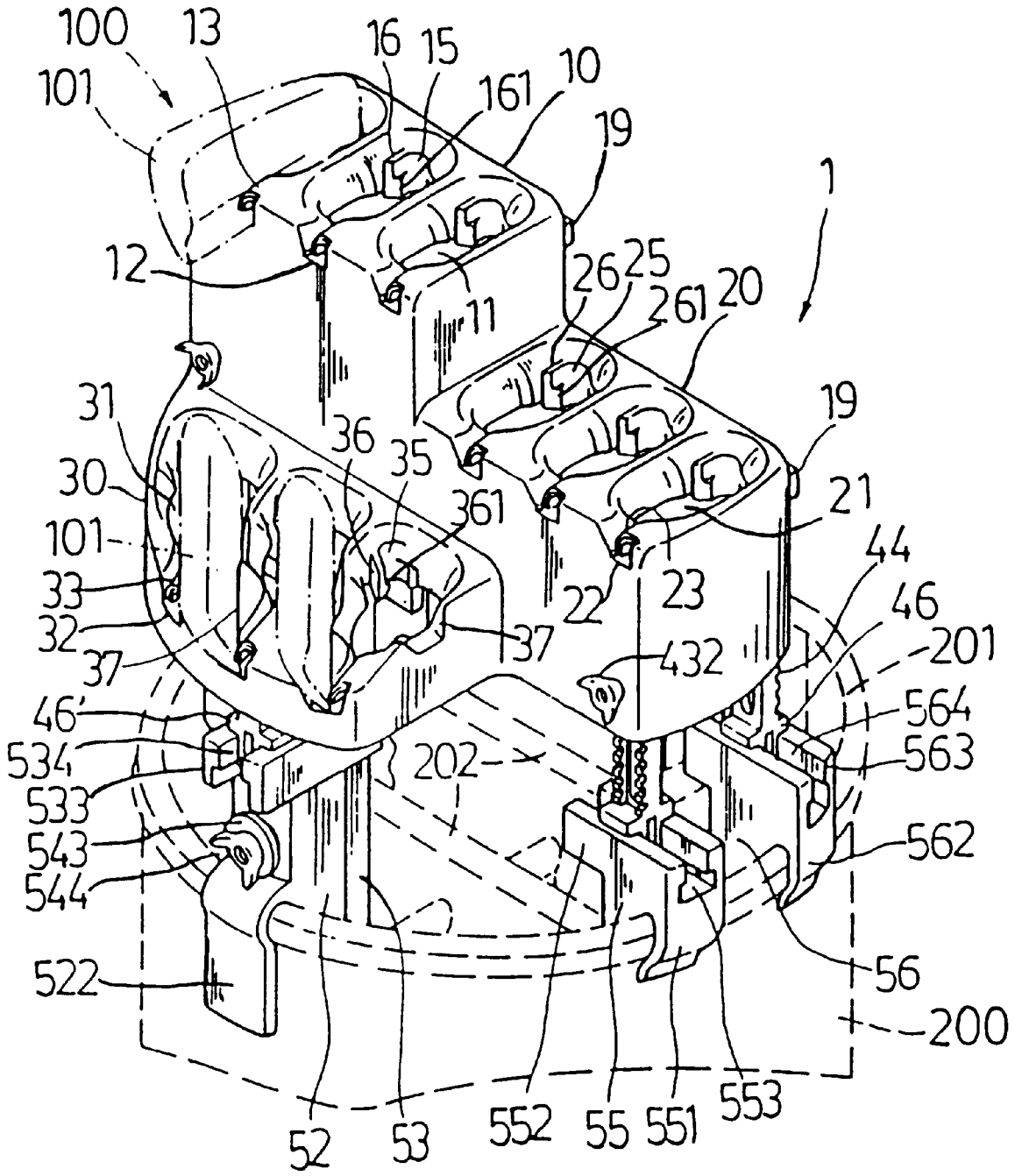
FIG. 14 shows yet another application example of the present invention, with the placement of clubs in the device of FIG. 12.

Referring to FIGS. 13 and 14, golf clubs 100 are inserted into the insertion slots 11, 21, and 31, and rested on the rack 10. The insertion slots 11, 21 and 31 each have a smoothly chamfered peripheral surface so that golf clubs 100 can be smoothly inserted into position without causing a damage. A golf club 100 can be rested in one insertion slot 11, 21 or 31 between two positions.

Referring to FIG. 14, when the head 101 of one golf club 100 is rested in the notch 12, 22, or 32 at one end of one insertion slot 11, 21, or 31, it is retained in place by the respective spring strips 13, 23 and 33. Because the heads 101 of storage golf clubs 100 are firmly retained in place, storage golf club heads 100 are maintained in good order. Because the spring strips 13, 23 and 33 are smoothly curved downwards, the heads 101 of inserted golf clubs 100 can be smoothly guided into position, and rested in the respective notches 12, 22, and 32. When picking up a storage golf club 100 from one insertion slot 11, 21, or 31, the spring power forces the respective spring strip 13, 23 and 33 to curve toward the peripheral wall of the corresponding insertion slot 11, 21, or 31, enabling the head 101 of the storage golf club 100 to be conveniently disengaged from the respective notch 11, 22, or 32.

Referring to FIG. 14, the head 101 of the golf club 100 can be secured to the clamp 15, 25 or 35 in the corresponding insertion slot 11, 21 or 31. Because the wing 16, 26 or 36 of the clamp 15, 25 or 35 is springy, the head 101 of the golf club 100 can easily be forced into engagement with the clamp 15, 25 or 35, or disengaged therefrom. After installation, the tip 161, 261 or 361 is hooked on the neck of the golf club 100 to hold down the golf club 100, and the free end of the head 101 is rested in the corresponding notch 12 or 22, or the corresponding groove 37. After the game, the golf clubs 100 which are respectively inserted into the insertion slots 11 and 21 at the first club holding section 10 and second club holding section 20 are disposed in such a manner that the necks of the heads 101 of the golf clubs 100 are secured to the clamps 15 and 25, and the free ends of the heads 101 of the golf clubs 100 are respectively rested in the notches 12 and 22. The golf clubs 100 which are respectively inserted into the insertion slots 31 at the third club holding section 30 are disposed in such a manner that the necks of the heads 101 of the golf clubs 100 are secured to the clamps 35, and the free ends of the heads 101 of the golf clubs 100 are respectively rested in the grooves 37. Because golf clubs 100 are firmly secured in place by the respective clamps 15, 25, and 35, the golf clubs 100 do not fall out of the insertion slots 11, 21, and 31 when the golf bag is turned upside-down.

Figure 15:
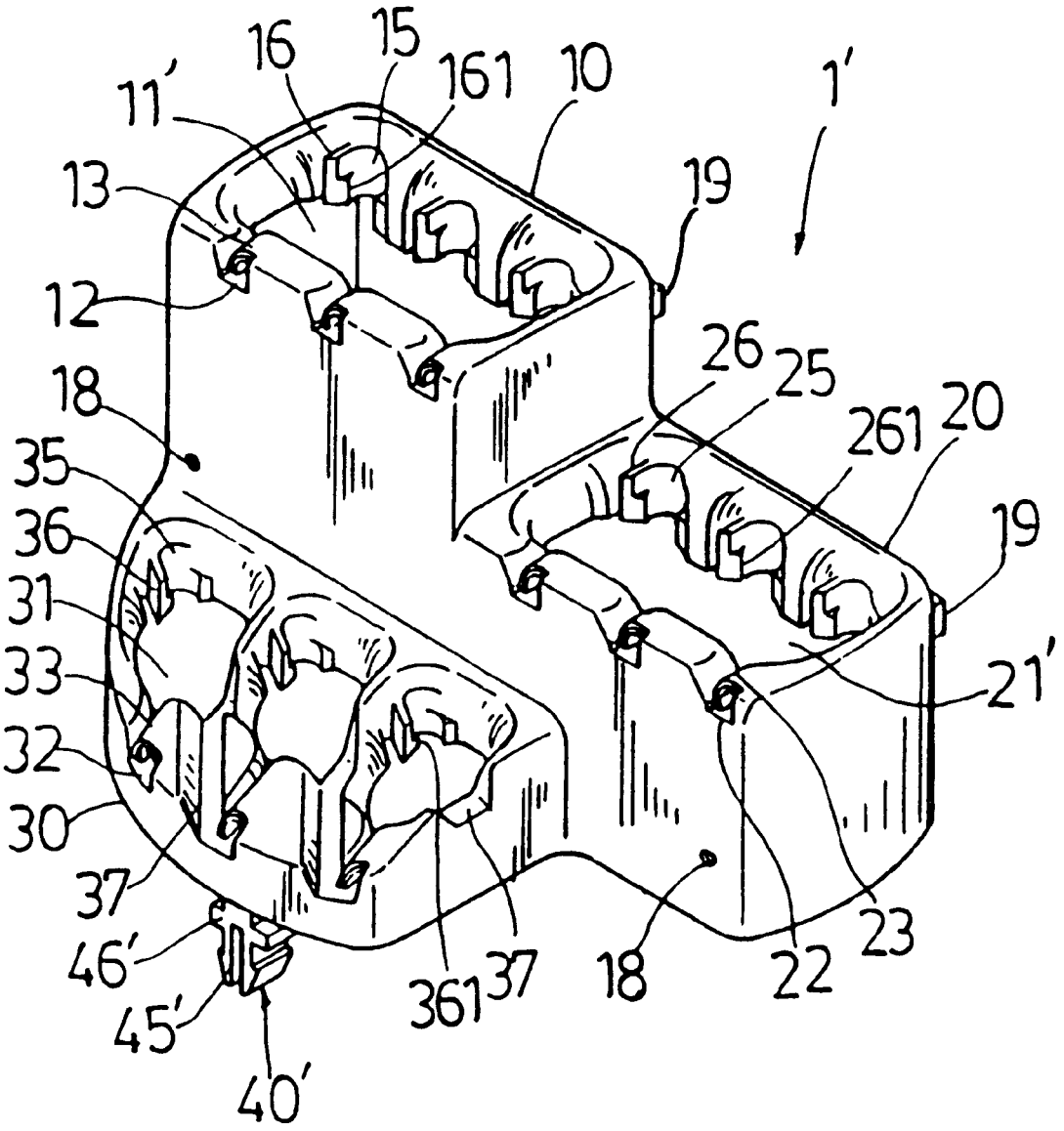
FIG. 15 is a perspective view of an alternate embodiment of the rack according to the present invention.

FIG. 15 shows an alternate form of the rack. According to this alternate form, the rack 1' is a three-step structure in which the insertion slots 11' in the first club holding section 10 and the insertion slots 21 in the second club holding section 20 are respectively communicated with one another, forming a respective opening.

Figure 16:
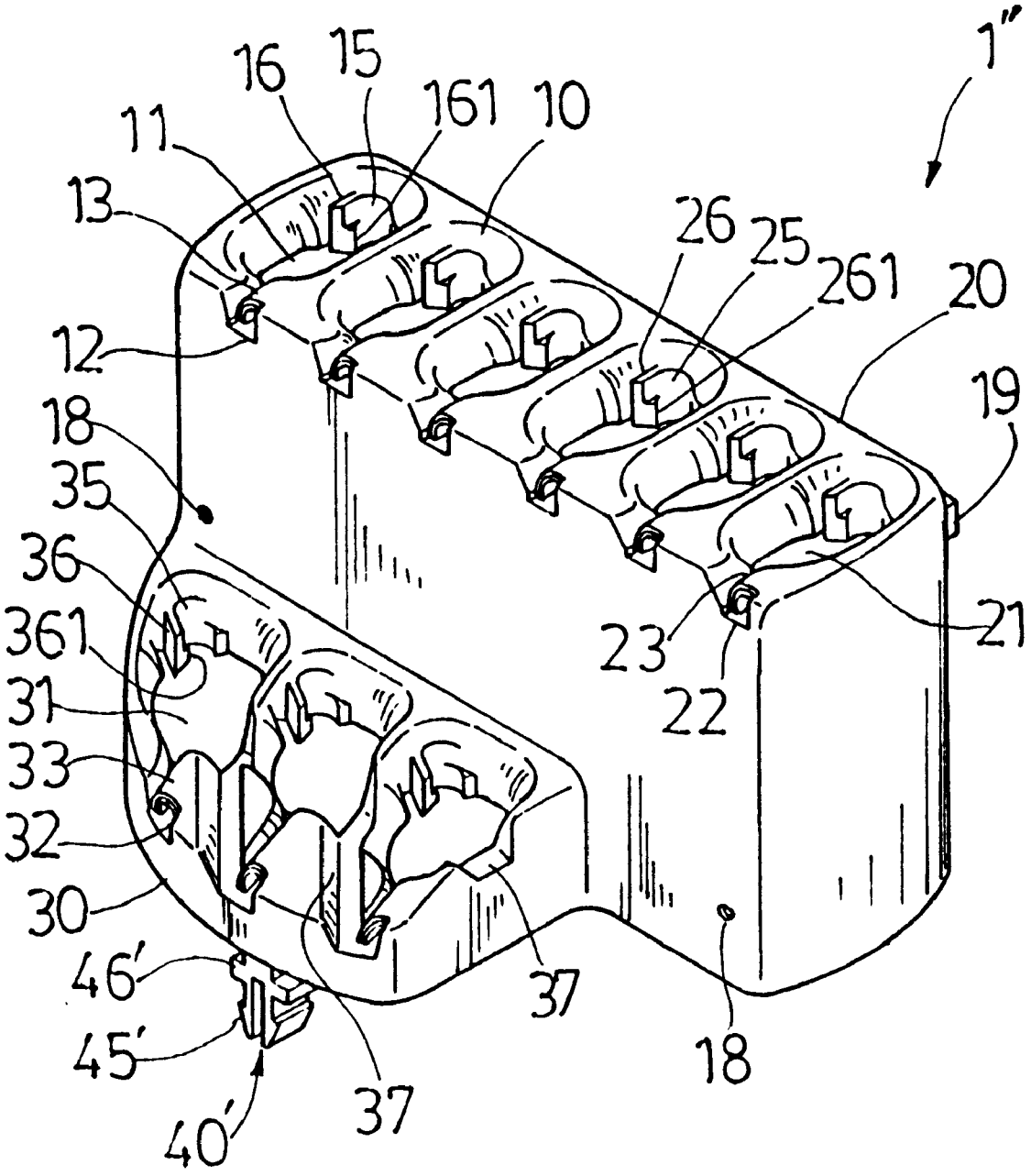
FIG. 16 is a perspective view of another alternate embodiment of the rack according to the present invention.

FIG. 16 shows another alternate form of the present invention. According to this alternate form, the first club holding section 10 and the second club holding section 20 have the same height, i.e., the rack 1" has a two-step structure.

Figure 17:
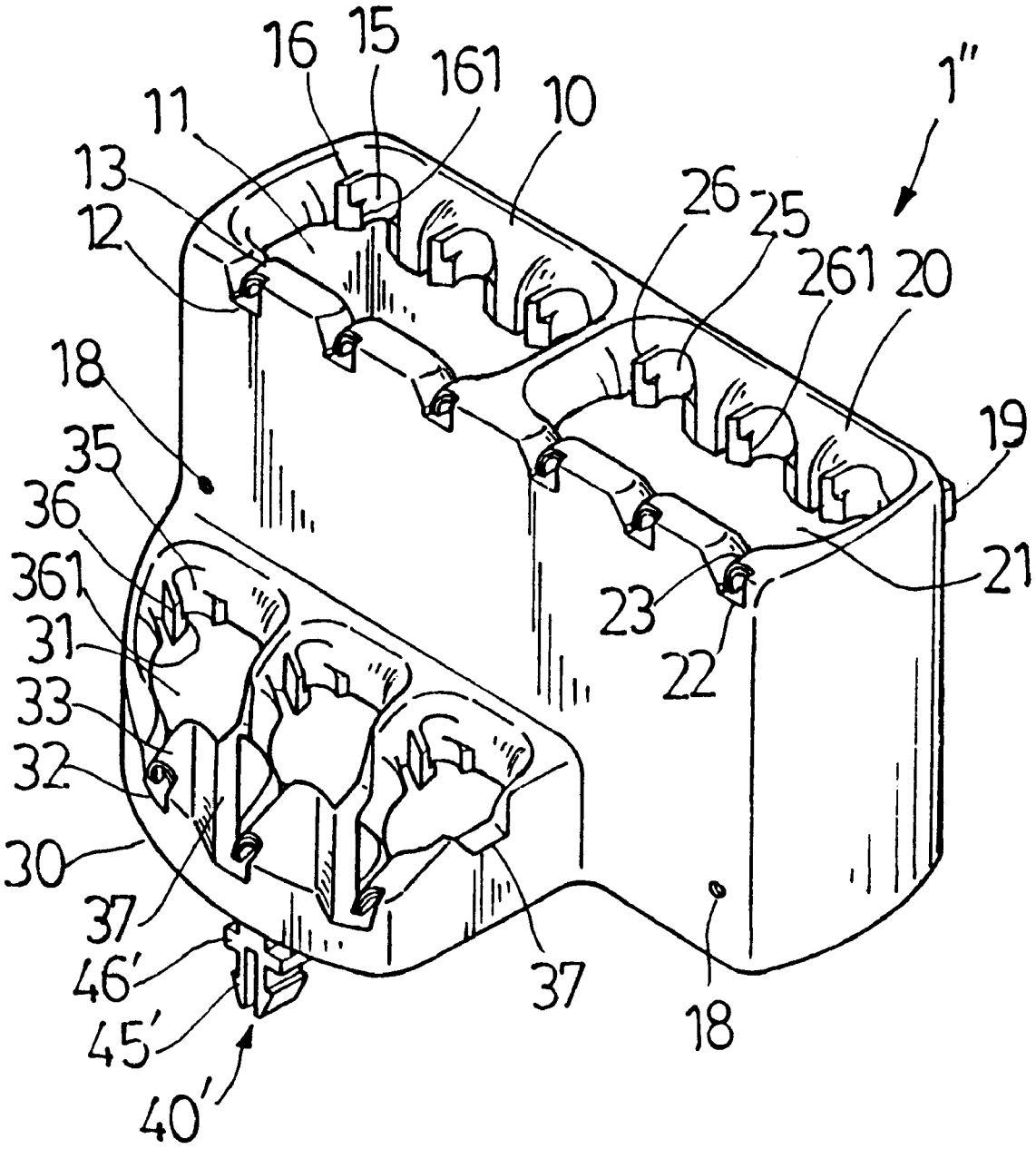
FIG. 17 is a perspective view of still another alternate embodiment of the rack according to the present invention.

FIG. 17 illustrates still another alternate form of the rack. According to this alternate form, the rack 1" is a two-step structure in which the insertion slots 11 in the first club holding section 10 and the insertion slots 21 in the second club holding section 20 are respectively communicated with one another, forming a respective opening.

Furthermore, the first and second club holding sections 10 and 20 have a common vertically disposed back side wall. When the rack 1, 1' or 1" is installed in the golf bag 200, the common vertical back side wall of the first and second club holding sections 10 and 20 is maintained spaced from the top cuff 201 of the golf bag 200 by a space, which is provided for holding wooden clubs. The common vertically disposed back side wall of the first and second club holding sections 10 and 20 is mounted with a flexible bumper 19 for protection. The top edge of the rack 1, 1' or 1" is smoothly curved. This design prevents a damage to the golf bag cover when closing the golf bag cover on the golf bag.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. A club rack for use with a golf bag comprising:

first, second and third club holding sections, the first and second club holding sections having a common front side wall, the third club holding section having a side wall;

the first, second and third club holding sections each positioned at a different height with respect to one another;

the third club holding section being integral with the common front side wall of the first and second club holding sections;

the first, second and third club holding sections each comprising a plurality of insertion slots, the insertion slots each having a vertical inner wall and a chamfered peripheral upper edge, each of the insertion slots having an adjacently positioned notch, each of the notches configured for receiving a head of a golf club and including a curved spring strip suspended from a lateral side thereof;

each of the insertion slots including a clamp formed therein, each of the clamps of the club holding sections positioned opposite a respective one of the notches;

a plurality of locating grooves positioned in the side wall of the third club holding section; and the clamps of the first, second and third club holding sections each having a resilient wing extending in a direction toward a center of a respective one of the insertion slots, each of the resilient wings having a tip configured to frictionally secure the head of the golf club.

2. The club rack as recited in claim 1, wherein the rack further comprises a mounting unit, a plurality of elongated first coupling members that can be adjustably fastened to the first and second club holding sections to vary a height of the club holding sections relative to the mounting unit, the first and second club holding sections having a plurality of through bores and threaded fasteners adjustably securing the first coupling members to the club holding sections;

the elongated first coupling members each including a longitudinal slot, a serrated side and a bottom end having a split hook configured for connection to the mounting unit;

the rack having an inner surface with a plurality of serrated portions with which the serrated sides of the elongated first coupling members are interlocked, each one of the elongated first coupling members is secured to the club holding sections by a respective one of the threaded fasteners extending through a respective one of the longitudinal slots and a respective one of the through bores;

the mounting unit comprising a plurality of second coupling members connectable to a top cuff of the golf bag and a plurality of third coupling members respectively fastenable to first partition boards of the golf bag;

the second coupling members of the mounting unit each comprising a downwardly longitudinally extended clamping mouth clampable on the top cuff of the golf bag, a top coupling head, and a T-groove in the top coupling head for receiving the split hook of a respective one of the elongated first coupling members;

the third coupling members of the mounting unit each comprising a downwardly extending serrated clamping mouth clampable on one of the partition boards of the golf bag, a clip fastenable to the top cuff of the golf bag, and a top coupling head having a T-groove therein configured for receiving the split hook of a respective one of the elongated first coupling members.

3. The club rack as recited in claim 1, wherein the rack further comprises a fixed coupling member formed integrally with the side wall of the third club holding section, the fixed coupling member having a bottom end with a split hook;

a mounting unit comprising a first coupling member, the first coupling member having a fixed bar, a movable bar, and a fastening device;

the fixed bar including a downwardly and longitudinally extending clamping mouth that is configured to be clamped on a partition board of the golf bag, a clip on one side of the fixed bar for fastening to a top cuff of the golf bag, a transverse through hole, a longitudinal track formed in a side wall of the fixed bar opposite to the clip, and serrated portions formed in the track; and the movable bar comprising a longitudinal slot and a coupling head having a T-groove therein configured for receiving the split hook of the fixed coupling member, the movable bar being fastened to the fixed bar by the fastening device, serrated portions of the movable bar are meshed with the serrated portions of the fixed bar.

4. The club rack as recited in claim 3, wherein the first and second club holding sections have vertical back sidewalls that are flush with each other and face away from the third club holding section, the back sidewalls including flexible bumpers configured to protect the rack.

5. The club rack as recited in claim 1, wherein the first and second club holding sections have a common height that is higher than the height of the third club holding section.

6. The club rack as recited in claim 5, wherein the insertion slots in each of the first and second club holding sections are configured such that the insertion slots are interconnected to form a unitary opening.

7. The club rack as recited in claim 1, wherein the rack further comprises a plurality of stretchers respectively provided in the notches and configured to increase a spring force each of the spring strips.

8. The club rack as recited in claim 1, wherein the insertion slots in each of the first and second club holding sections are configured such that the insertion slots are interconnected to form a unitary opening.

* * * * *